United States Patent [19]

Gilbertson

[11] Patent Number: 4,656,836

[45] Date of Patent: Apr. 14, 1987

[54] PRESSURIZED, ICE-STORING CHILLED WATER SYSTEM

[76] Inventor: Thomas A. Gilbertson, 216 Sandringham, North, Moraga, Calif. 94556

[21] Appl. No.: 732,760

[22] PCT Filed: Aug. 23, 1984

[86] PCT No.: PCT/US84/01349

§ 371 Date: Apr. 23, 1985

§ 102(e) Date: Apr. 23, 1985

[87] PCT Pub. No.: WO85/01097

PCT Pub. Date: Mar. 14, 1985

[51] Int. Cl.[4] ..... F25D 17/02; F25D 3/00

[52] U.S. Cl. ..... 62/185; 62/59; 62/435; 165/104.27; 137/568

[58] Field of Search ..... 62/59, 99, 185, 201, 62/430, 434, 435; 165/104.17, 104.27, 104.32, 135, 143; 137/563, 568

[56] References Cited

U.S. PATENT DOCUMENTS

| | | | |
|---|---|---|---|
| 2,596,195 | 5/1952 | Arbuckle | 62/335 |
| 2,984,458 | 5/1961 | McFarlan | 62/305 X |
| 3,271,968 | 9/1966 | Karnath | 62/59 |
| 4,254,635 | 3/1981 | Simon et al. | 62/123 X |
| 4,345,715 | 8/1982 | Van Craenenbroeck | 137/568 |

*Primary Examiner*—Harry Tanner

*Attorney, Agent, or Firm*—Flehr, Hohbach, Test, Albritton & Herbert

[57] ABSTRACT

A sealed, pressurized thermal storage system (20) which uses ice as the static thermal storage medium. The system is applicable to diverse cooling and storage requirements such as air conditioning and other relatively large scale cooling loads. The heart of the system is one or more ice-storage chilled water heat exchangers (21, 40) which form a closed pressurized water circulation system (21) with the loads (22) for circulating chilled water thereto. A refrigeration piping system (55, 57) circulates refrigerant through the water heat exchanger(s) (21, 40) for cooling the sealed water system and for making and storing ice along the refrigerant piping (55) within the water heat exchanger (40). An overflow/return circuit (27) compensates for pressure variations within the sealed water system, e.g., to accommodate volume changes in the stored ice.

16 Claims, 15 Drawing Figures

FIG. 1
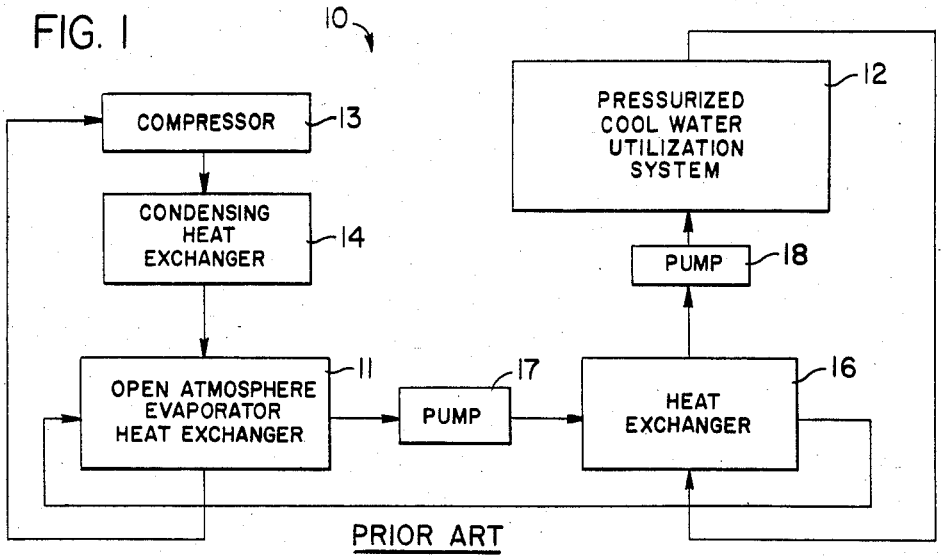
PRIOR ART
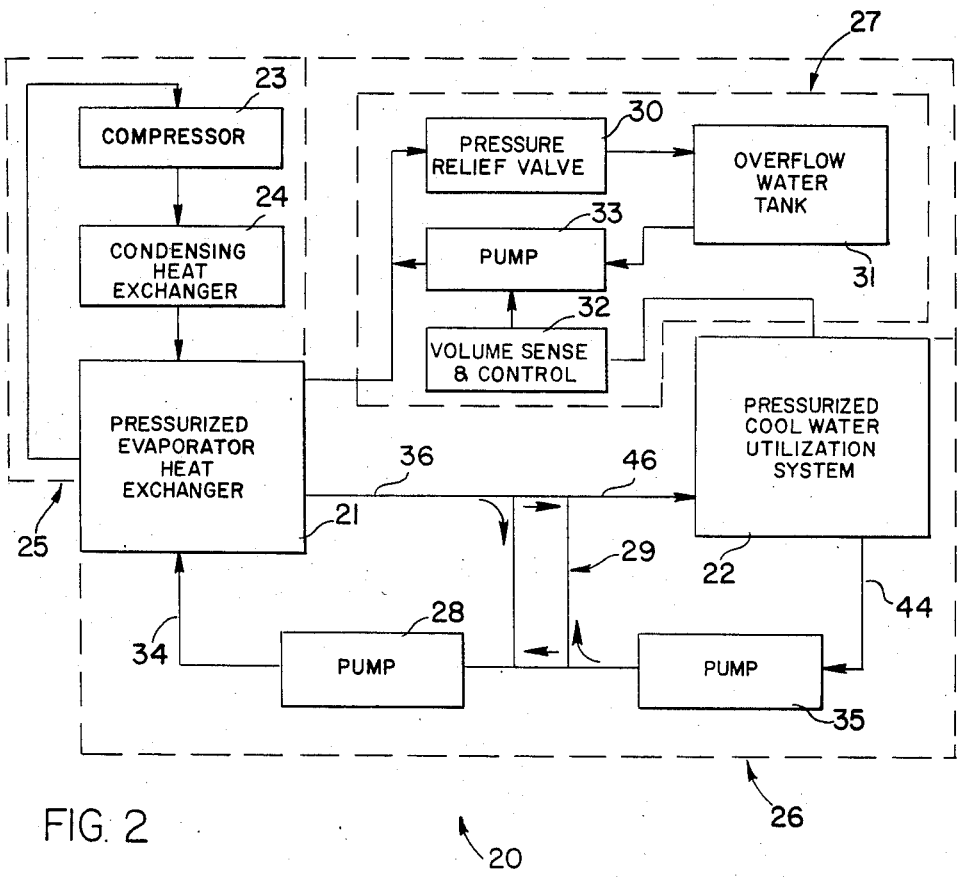
FIG. 2

FIG. 4
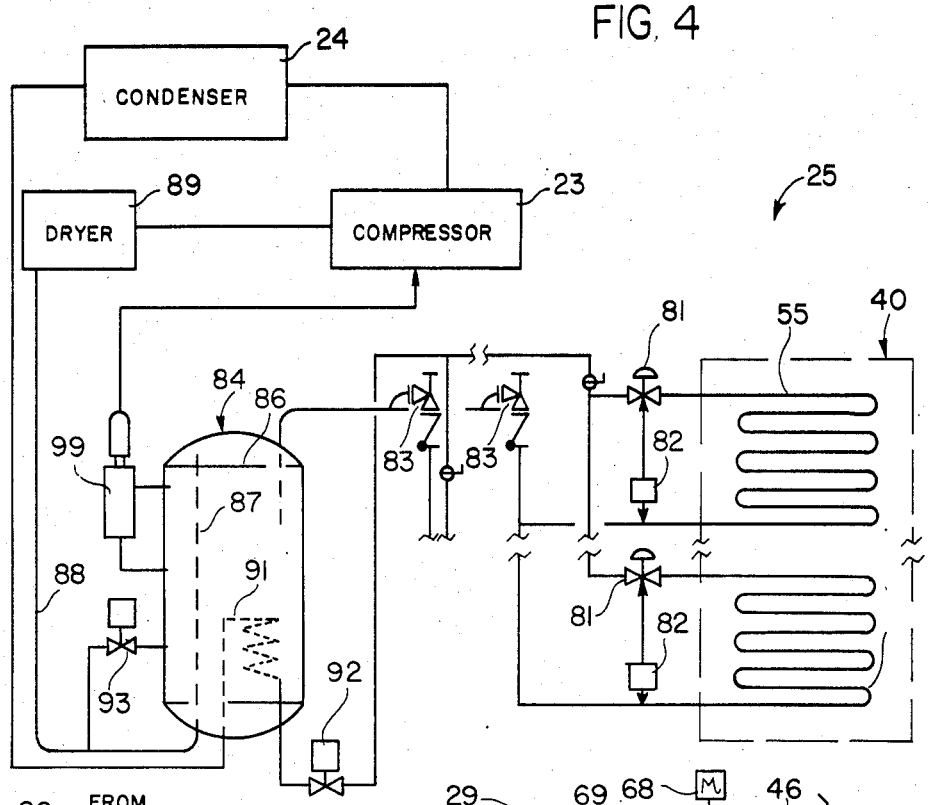
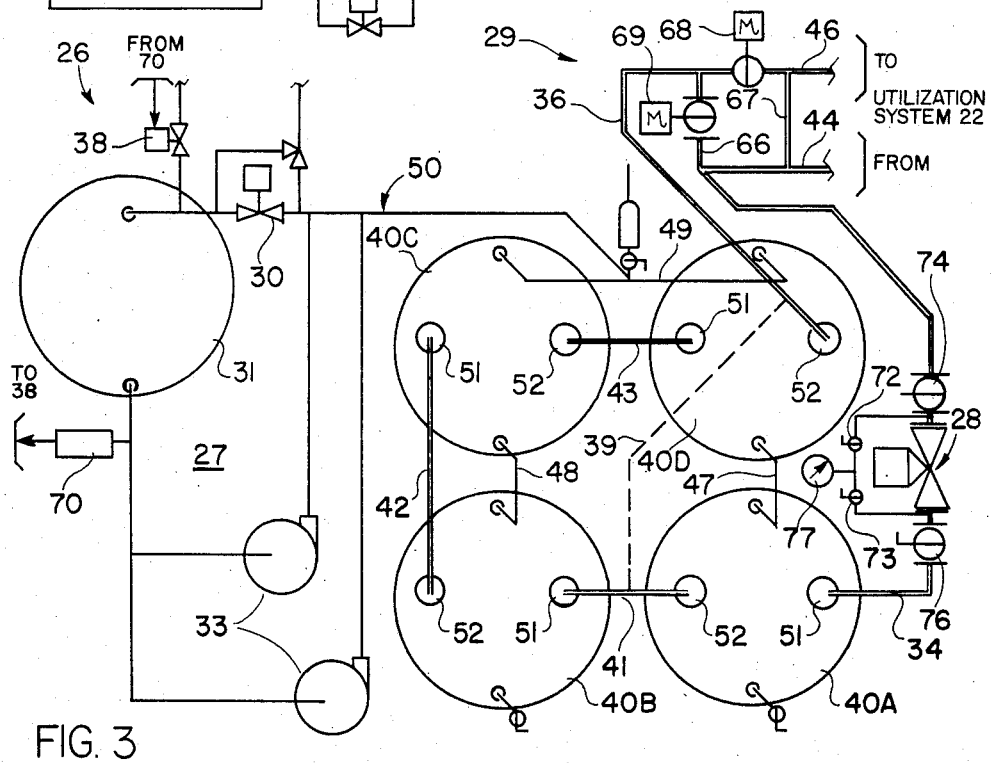
FIG. 3

FIG. 6
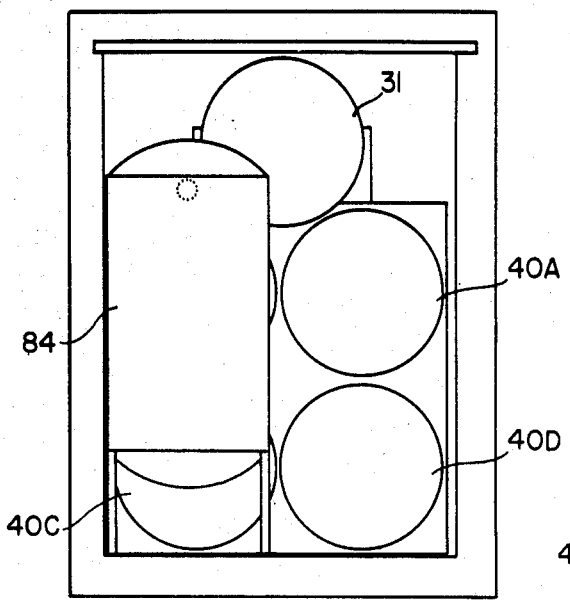
FIG. 5
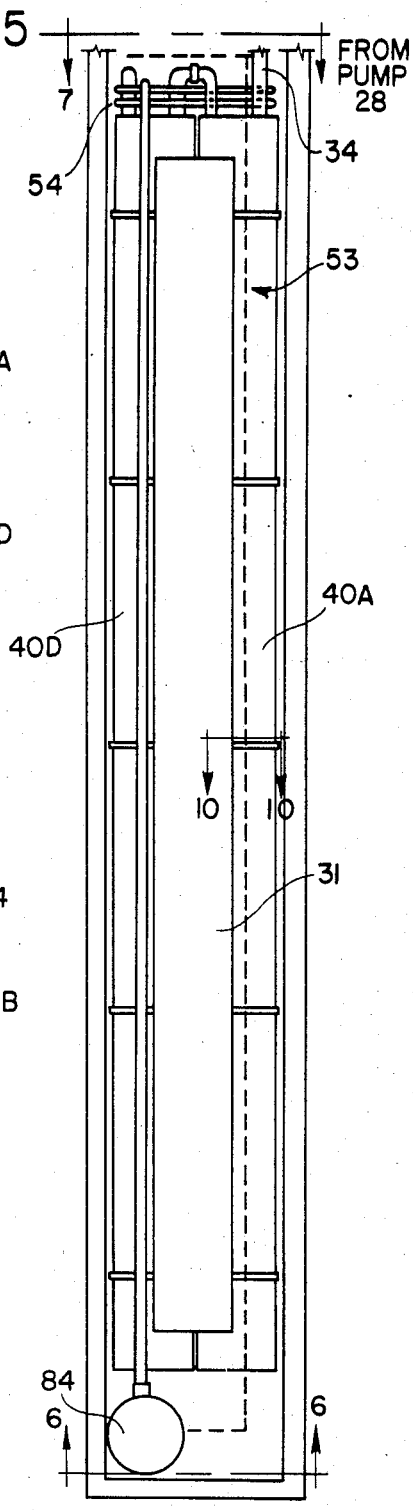
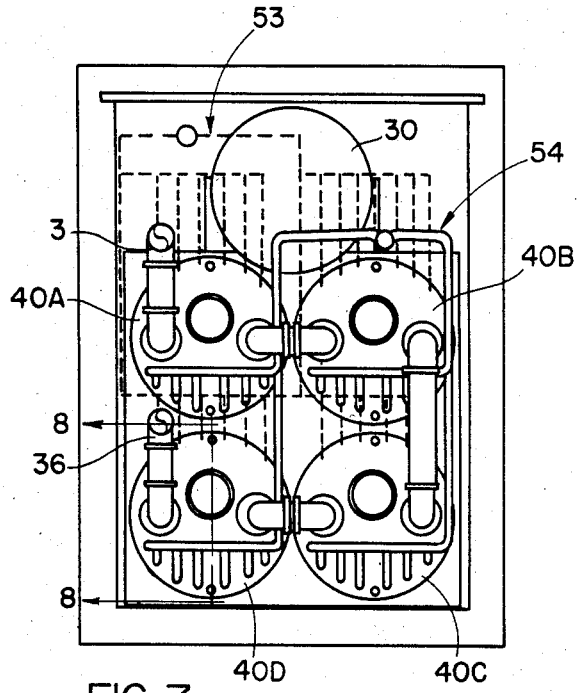
FIG. 7

PRESSURIZED, ICE-STORING CHILLED WATER SYSTEM

BACKGROUND OF THE INVENTION

This invention relates to cooling systems and to thermal storage systems which use ice storage.

The object of "cool[ storage (also called "thermal storage") is to extract heat from a thermal reservoir during one time period and, during a different time period, to use the reservoir to extract heat from another environment. One important application of thermal storage is in building air conditioning systems. Ice and chilled water are the usual media for thermal storage. Each has advantages and disadvantages. For example, pure chilled water systems (no ice storage) can use higher refrigeration temperatures than ice storage systems (approx. 30° F. vs. 20° F.). In addition, ice systems have a distinct size advantage, as a rule-of-thumb requiring about one-fifth the storage volume of pure chilled water systems. Because of such desirable features, the ice-based thermal storage systems are experiencing an increasingly wide range and large volume of usage. It is to such ice building systems that the present invention is primarily directed.

Ice-based thermal storage systems can be classified as dynamic or static. In dynamic systems, ice is made in chunks or as crushed ice and is stored in large containers. In static systems, ice is formed on the cooling coils of the storage vessel itself. FIG. 1 is a block diagram example of an application system 10 which uses a prior art ice-based static thermal storage system. Static ice-storage system 10 utilizes an open tank or other unpressurized water heat exchanger 11, with heat extraction being provided, for example, by piping refrigerant through evaporator tubes in the water. It should be noted that, as used herein, "unpressurized" means open or at atmospheric pressure, whereas "pressurized" means above atmospheric pressure at the surface of the water.

The system 10 is typical of prior art application systems in that it comprises three major component systems or subsystems: a pressurized refrigeration system; an unpressurized chilled water heat sink system; and a pressurized chilled water utilization system which includes the building air conditioning loads. The refrigeration system includes the evaporator section of unpressurized heat exchanger system 11, a compressor 13 which withdraws and compresses the gaseous refrigerant from the heat exchanger, and a condensing heat exchanger 14 for cooling and condensing the refrigerant gas to liquid before it is returned to the evaporator in heat exchanger system 11.

The pressurized chilled water utilization system includes a second heat exchanger system 16, which includes a pressurized component. A pump 17 circulates system water between the two heat exchanger systems to extract heat from the chilled water utilization system at heat exchanger 16 and in turn have heat extracted by the refrigeration based ice storage system at heat exchanger 11. Finally, the cool water utilization system includes a pump or pump system 18 for circulating the water through the pressurized component in heat exchanger system 16 and other heat exchange water coils included in the system.

The cooling/air conditioning system 10 has achieved increasingly wide-spread application during the past several years, in no small part due to the fact that it is the only previously known application technology for such ice-storage water-circulation systems. A strong impetus for use of thermal storage for commercial building air conditioning systems has arisen from the difficulty that commercial power companies have experienced in bringing up a sufficient electrical power generation capability to handle peak electricity usage, especially in major metropolitan areas having widespread use of commercial air conditioning. The peak power demand on the power generation capability of the utility on a very hot day can put a severe strain on the power generation system. About thirty percent of the summer peak load is contributed by commercial air conditioning demand. This contrasts with an approximate two percent contribution by residential peak cooling demand. Thermal storage is the only approach that can shift electricity usage from a peak demand period to an off-peak period. Thus, it is anticipated that thermal storage for commercial air conditioning systems and other chill water system applications will become increasing important in the future.

Moreover, it has been shown that with proper application of thermal storage technology, even utilizing prior art approaches, an ice storage system can be competitive with a conventional centrifugal cooling plant in a commercial air conditioning system. A case history of such an implementation of a prior art type of thermal storage system using ice building technology of the prior art is set forth in a paper by Gilbertson and Jandu entitled "Twenty Four-Story Office Tower Air-Conditioning System Employing Ice Storage—A Case History." This paper was presented at an ASHRAE conference in Atlanta, Ga. in January, 1984, and will later be published in the "Transactions" of that conference and the discussion therein is hereby incorporated by reference.

As noted in the Gilbertson et al. paper, thermal storage systems of the ice building type provide a number of advantages over conventional centrifugal cooling plant systems. The major advantages are lower operating costs, reduction in certain building costs, improvements in reliability, and reduction in maintenance. Furthermore, in some instances thermal storage of the ice building type will enable commercial air conditioning to be implemented in extremely hot climates in which conventional centrifugal cooling plants are essentially useless during peak day time temperatures. In addition, thermal storage of the ice building variety may enable the benefits of commercial air conditioning to be utilized in developing countries which have limited power generation capacity. Shifting commercial air conditioning load requirements to cooler night time hours reduces the need for new power plants and, in addition, provides more steady, efficient usage of existing power stations by reducing load shifting and starting and stopping of generation equipment.

The major contribution to lower operating costs of an ice storage system is the availability of less expensive electricity at night to store cooling capacity which is then available to meet peak air conditioning loads during the day. Electricity utilization is also more efficient during night time hours when temperatures are lower and heat rejection to the ambient atmosphere is more efficient. In certain parts of the United States, total savings of sixty percent on electricity costs are achievable.

However, prior art thermal storage systems also have limitations and undesirable features. For example, the bulk and weight of the water and vessel of system 11 used in such applications dictates that it be placed at ground or grade level in all but the smallest applications. However, where all or part of the load/utilization system is higher than the heat exchanger, constraints imposed by the water head of the utilization system and pumping requirements prohibit the use of an unpressurized utilization system. That is, the second heat exchanger system 16 is required to interface the pressurized and unpressurized systems. The use of an open atmosphere heat exchanger 11 and associated system and the pressurized heat exchanger 16 and associated system requires considerable investment in apparatus and interconnections. The requirement of an additional heat exchanger system 16 interconnecting the open tank and sealed chill water systems also reduces the heat transfer efficiency of the system.

In addition, while open atmosphere water tanks are euphemistically referred to as "sweet water" systems, they are anything but sweet. The large volume of water is subject to contamination by the external environment. The system components are subject to rust and to deterioration caused by alternate wetting and drying as the water level changes due to changes in the volume of the hydraulic system resulting from the freezing and thawing of ice.

It is thus apparent that there is a need for a better approach to thermal storage systems.

OBJECTS OF THE INVENTION

It is the principal object of this invention to provide an improved ice building type of thermal storage system for chill water applications.

It is a further object of this invention to provide an ice storage system having improved operating characteristics and reduced maintenance.

SUMMARY OF THE INVENTION

One aspect of this invention features a chill water system which utilizes a structural arrangement defining a closed vessel for containing a volume of water entirely filling the water and a heat exchanger arrangement, including a solid heat exchange surface area disposed within the interior of the vessel for forming a volume of ice surrounding and adhering to the heat exchange surface area. A chill water utilization arrangement communicates with the closed vessel and includes an arrangement for circulating water under pressure through the vessel in direct contact with the volume of ice on the heat exchange surface area. A compensation arrangement is provided for automatically removing water from the closed vessel during formation of the volume of ice to prevent build up of destructive internal pressure within the vessel and for automatically returning water to the closed vessel during melting of the volume of ice by the circulating water to maintain pressure in the vessel.

Preferably, the compensation arrangement includes a second vessel for holding a volume of water, including water removed from the closed vessel and the water within the second vessel and the water circulating through the closed vessel and the chill water utilization arrangement partially comprises a rust inhibiting chemical.

In a preferred embodiment, the structural arrangement comprises an elongated cylindrical vessel having first and second ports therein for entry and exit of the circulated water. In this preferred embodiment, the heat exchanger arrangement comprises a plurality of refrigerant carrying tubes each disposed in a serpentine arrangement of individual tube sections, which extends substantially through the entire length of the vessel such that the volume of ice is formed as a cylindrical volume of ice surrounding each of the tube sections. Alternatively, the first and second port may be formed in opposite end walls of the elongated cylindrical vessel such that the water circulating through the vessel flows around the cylindrical volumes of ice in a single pass from the first port to the second port, or the first and second ports may be formed in a single end wall of the vessel on opposite halves thereof and an elongated baffle plate may be mounted within the elongated cylindrical vessel to divide the vessel into first and second compartments which individually communicate with the first and second ports, thereby producing a two-pass water flow pattern through the vessel.

In practice, the structural arrangement will typically define a plurality of separate closed vessel each containing a volume of water which entirely fills the vessel, and the heat exchanger arrangement will include a separate solid heat exchange surface area disposed within the interior of each of the closed vessels for forming separate volumes of ice surrounding and adhering to the heat exchange surface areas therein. In this arrangement the chill water utilization arrangement will communicate with each of the closed vessels and preferably will include an arrangement for circulating water under pressure through each of the vessels in series. The compensation arrangement will communicate with each of the separate vessels for automatic removal and return of water thereto under conditions previously discussed.

The compensation arrangement may comprise a water circuit communicating with the interiors of each of the separate closed vessels and an overflow vessel. A pressure responsive element communicating with the water circuit admits water to the overflow vessel from the separate closed vessels in response to a sensed pressure exceeding a preset value during periods when ice is formed in the separate vessels. A second pressure responsive means is provided to communicate with the water circuit for pumping water from the overflow vessel to the separate closed vessels during periods when ice in the separate vessels is being melted.

Another aspect of this invention features a method for providing chilled water under pressure to a chill water utilization circuit with the method involving forming a volume of ice on a solid heat transfer surface disposed within a sealed vessel entirely filled with water. The method further includes the step of removing a volume of water from the vessel as the volume of water is formed to prevent destructive build up of pressure within the vessel. The method further utilizes the step of circulating water from the chill water utilization circuit through the vessel in direct contact with the volume of ice for producing chilled water and thereby melting the ice. Finally, the method includes a step of supplying additional water to the vessel as the ice is being melted to maintain pressure within the vessel.

The thermal storage, ice building system of this invention eliminates many of the disadvantages of the prior art ice building systems and provides additional advantages which dramatically enhance the utility and commercial attractiveness of the ice building approach to thermal storage utilization for commercial chill water system applications. The system and method of this invention permits all components of the system to be sealed and pressurized which dramatically reduces maintenance costs. The ice bottles themselves and the whole chill water utilization system may be filled with chemically treated water to eliminate rust and corrosion of metal parts. Accordingly, no expensive coatings on metal surfaces in contact with the chilled water are required. This sealed, treated water feature enables the convenient placement of the closed vessels (sometimes referred to as "ice bottles") to avoid taking up building space and the bottles are much easier to insulate for further thermal storage efficiency. For example, the ice bottles can be placed under basement floors or parking lots with only access to one end of the bottle being required for any inspection and/or maintenance necessary to be performed. The system of this invention may be advantageously manufactured utilizing an integral insulation bonding and fiberglass reinforced plastic shell winding technique as currently implemented by Midwesco, Inc., of Niles, Ill. This permits the ice bottles to be directly buried in the ground with only the front faces thereof extending through a concrete wall and with the ice bottles resting on a buried concrete pad. This produces a substantial savings in construction costs by eliminating the need for an enclosed vault to house the open atmosphere tanks of prior art systems.

The pressurized ice bottle concept of this invention avoids the need for a second heat exchanger system to accommodate the water pressure needed in the chill water circuit of a tall building. This results in substantial improvements in efficiency and lowered installed costs for thermal storage. Furthermore, no agitation in the ice tank is required for good heat transfer between the volume of ice on the heat exchange surface and the water being pumped through the ice bottle.

The system of this invention further improves the beneficial cost reduction impact on structural, electrical, and architectural portions of a building project because of the ability to provide longer residence time of the chill water in contact with the ice for lowering the temperature of the water entering the chill water utilization circuit. The lower water temperature available from the system of this invention, as contrasted to prior art systems, permits further reduction in the numbers of rows of tubing in the water coils in the utilization circuit which in turn lowers the fan horsepower required and the size of ducting for required delivery of the cool air. Air systems using substantially colder supply air, i.e. $\approx$43° F. vs. 55° F., have been shown to reduce operating cost by as much as 25%.

While eliminating many of the objectionable aspects of prior art approaches to ice building type of thermal storage systems and by providing further enhancements to the ice building technology, the system and method of this invention will speed acceptance of thermal storage as the technology of choice for chill water systems utilized in a number of commercial applications, including the most widespread application in air conditioning of large commercial buildings.

Other objects, features, and advantages of this invention will be apparent from the consideration of a detailed description given below in connection with the accompanying drawings.

BRIEF DESCRIPTION OF THE DRAWINGS

FIG. 1 is a block diagram of a prior art, open atmosphere, ice storage and cooling system;

FIG. 2 is a block diagram showing the essential features of an embodiment of the present pressurized, ice-storing chilled water system;

FIGS. 3 and 4 are, respectively, schematic representations of the chilled water piping system of FIG. 2 and the refrigeration system of FIG. 2;

FIG. 5 is a top planar view, in partial schematic form, of a typical installation for the pressurized heat exchanger(s) and associated equipment of FIG. 2;

FIGS. 6 and 7 are enlarged opposite end lateral cross-section views of the system shown in FIG. 5 taken in the direction of the arrows therein;

DETAILED DESCRIPTION OF SEVERAL EMBODIMENTS

Figure 8:
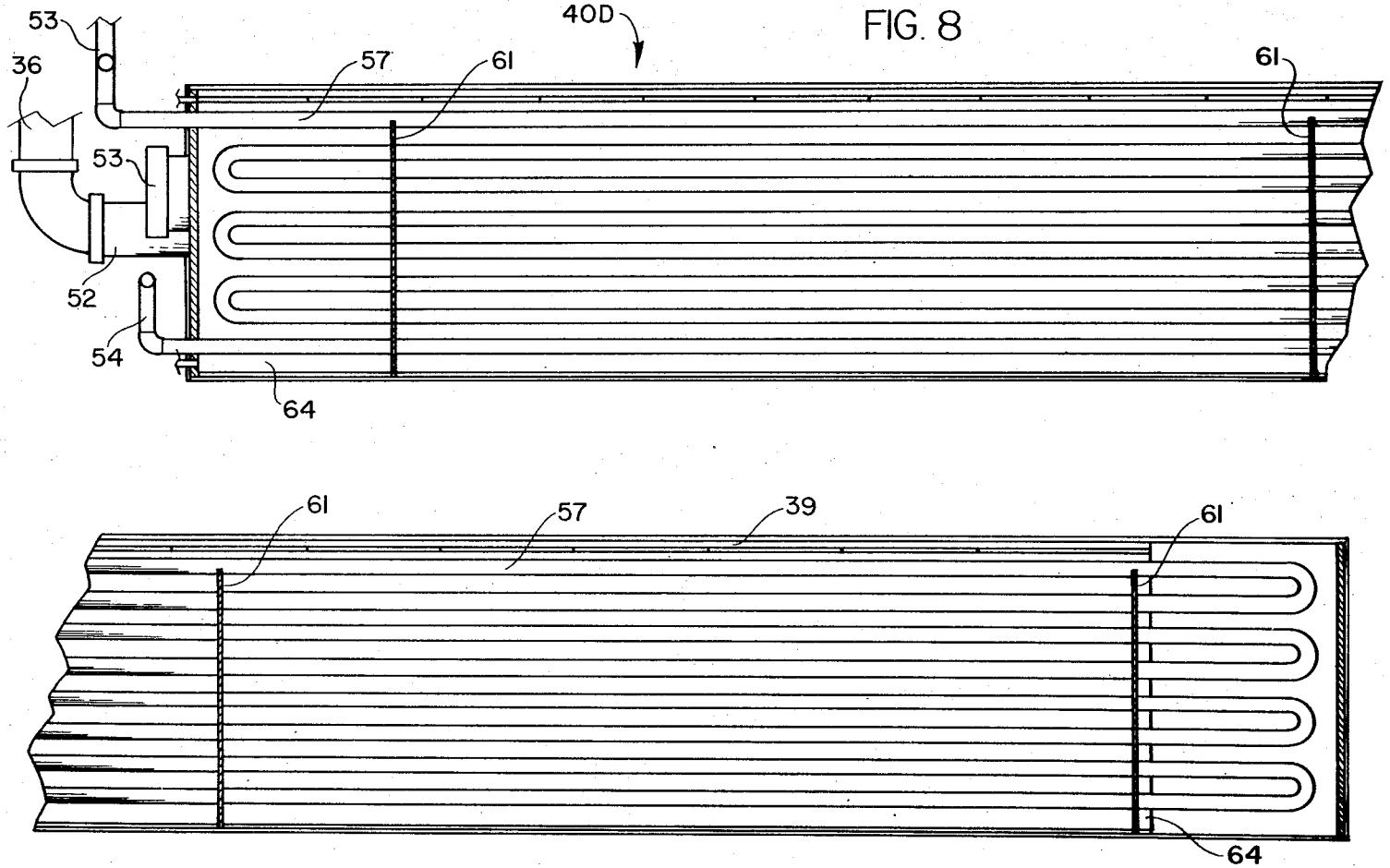
FIG. 8 is a longitudinal cross-section view of one of the heat exchanger bottles taken in the direction of the arrows in FIG. 7.

FIG. 2 is a block diagram of a pressurized ice-storing chilled water system which incorporates the features of the present invention. The chilled water system is designated generally by reference numeral 20. In contrast to the prior art system 10 of FIG. 1, the present system comprises but two major subsystems: a pressurized refrigeration system 25 and the combined water heat exchanger and utilization system 26. The pressurized ice-storing chilled water system 26 also includes an overpressure/return system 27 (also referred to as a "compensation system") which compensates for changes in water pressure or volume, such as those which result from ice making and melting.

The overpressure/return system 27 includes a pressure relief valve 30 which permits the discharge of water from the chilled water system into an overflow tank 31 in response to a predetermined pressure relief setting. In addition, when the system water volume falls below a predetermined level, volume sense and control means 32 activates a water pump 33 to transfer water from the overflow tank 30 to the heat exchanger/utilization system.

The pressurized refrigeration system 25 includes the evaporator section of heat exchanger 21, a compressor 23 which withdraws and compresses gaseous refrigerant from the heat exchanger 21, and a condensing heat exchanger 24 which cools and condenses the gas to liquid before returning it to the evaporator section of the heat exchanger 21.

The water system 26 includes the water circulation section of heat exchanger 21 (shown in more detail, for example, in FIG. 3), and a pump 28 for circulating water to utilization system 22 (typically the loads of an air conditioning or other cooling system). A blending system 29 can be used to blend relatively warm water from the utilization system 22 with the colder outlet water from the heat exchanger to controllably warm this water before it is input to the utilization system. As configured, the blending system divides the system water circulation into a primary circuit associated with the heat exchanger 21 and a secondary circuit associated with utilization system 22 and allows separate primary or secondary circulation. This is useful, e.g., for providing circulation in the heat exchanger 21 to enhance heat transfer during the storage-only mode of operation.

FIG. 3 is a detailed schematic representation of the pressurized ice-storage chilled water system 22. The key feature of the system 22 is ice storage heat exchanger system 21 and, in particular, the chilled water circulation system thereof which includes bottles/tanks 40 (hereafter "ice bottles"). The exemplary heat exchanger 21 utilizes four of the ice bottles 40A–D shown in detail in FIGS. 8–10. However, the number used is merely illustrative and may be varied from one to many depending on the capacity of the individual bottles and the storage and cooling requirements of the particular application.

Figure 9:
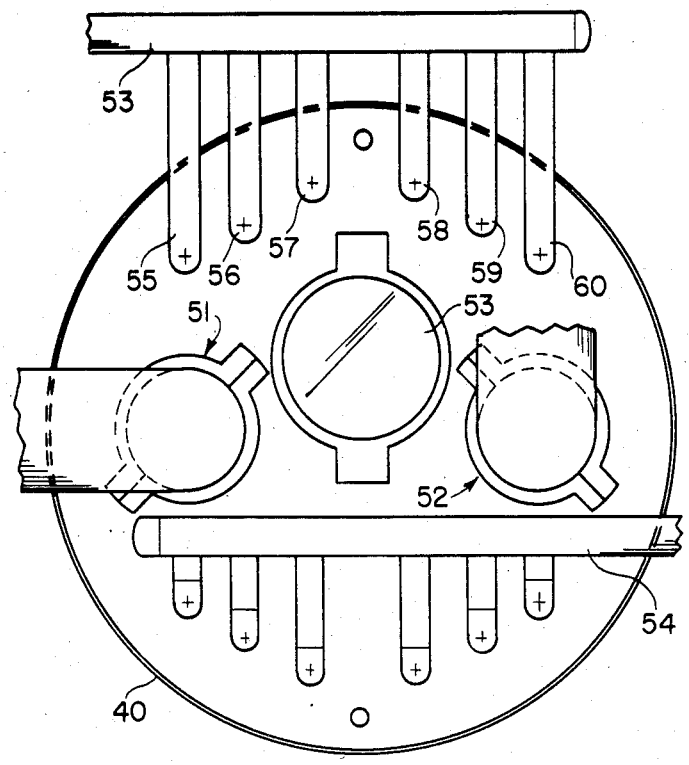
FIG. 9 is an enlarged end view of one of the heat exchanger bottles shown in FIG. 7.
Figure 10:
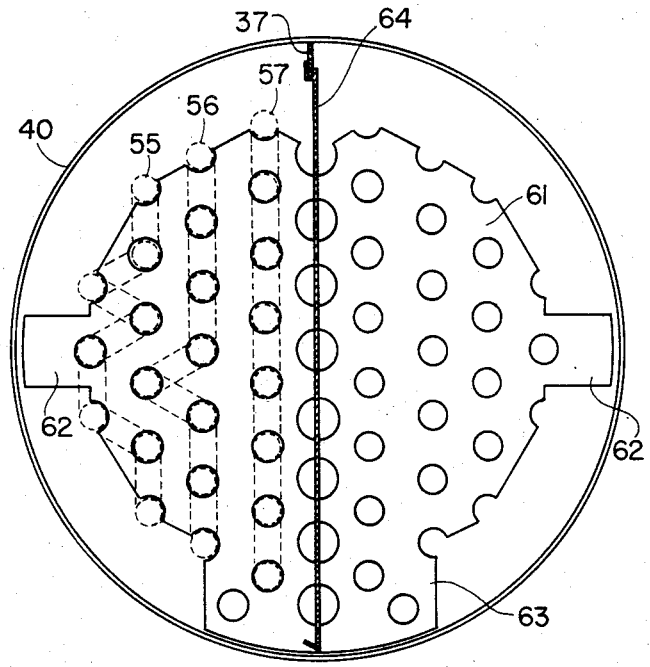
FIG. 10 is a lateral vertical cross-section view of one of the heat exchanger bottles of FIG. 5 taken in the direction of the arrows therein.

Referring now specifically to FIGS. 8–10 and in particular to FIGS. 8 and 9, the ice bottles 40 include refrigerant inlet header 53 and outlet header 54, which connect in parallel across serpentine refrigerant pipes or tubes 55–60. The multiple piping system is used to increase the refrigeration capacity of each bottle. As shown more clearly in FIG. 10, the routing of each refrigerant pipe is chosen to provide equal length and thereby equalize the refrigeration and heat transfer of the six individual pipes 55–60. The refrigerant pipes are supported within the ice bottles by tube cradle sheets 61—61. In addition to the support function, the cradle sheets create water flow turbulence which promotes uniform heat transfer between the refrigeration pipes and the circulated water. Flanges 62—62 and 63 also provide support and promote turbulence. It should be apparent that other configurations of refrigerant tubes and other mounting arrangements would be employed.

Water is inlet to each bottle 40 via an inlet port 51, is channeled along substantially the entire length of the bottle by baffle 64 (see FIGS. 8 and 10), then returns along the opposite side of the tank to outlet port 52. To implement this two-pass arrangement, the baffle 64 butts against the front or inlet/outlet end of the ice bottle while a narrow gap is provided between the baffle and tank at the opposite end. Of course, where an even greater heat transfer rate is necessary, it is possible to use two or more baffles and thereby provide a multiple pass system. A single pass arrangement without a baffle may also be used and is described below.

As will be appreciated, the baffle 64 must fit snugly against the interior wall of bottle 40. It is also desirable to first assemble the baffle 64 and the several tube cradle sheets 61 with refrigerant tubes mounted therein, and then slide the assembly into place within the ice bottle. The positioning and fit of this subassembly can be very difficult to achieve, since the available large tanks may contain surface irregularities. In particular, the bottles 40 may have longitudinal and circumferential welding seams. The latter is particularly detrimental to assembly and fit. The problem is solved by attaching a resilient seal 39 along one longitudinal edge of the baffle 64. As an example, a neoprene seal 39 which is nominally 0.5" thick by 2.5" wide is used in the application described below. The deformable seal 39 has proven to permit insertion of the assembly into the bottle 40, yet provide a satisfactory, snug fit between the baffle 64 and the bottle interior.

As shown in FIG. 3, the ice bottles 40 are interconnected in series fashion as follows: the inlet 51 of bottle A is connected via inlet pipe 34, ice pump 28 and utilization circuit pump 35 (shown in FIG. 2) to the outlet pipe 44 of the secondary or utilization system 22; the outlets 52 of bottles A, B and C are connected, respectively, by piping 41, 42 and 43 to the inputs 51 of bottles B, C and D; and, the outlet 52 of Bottle D is connected via pipe 36 to inlet pipe 46 of the utilization circuit 22. The bottles are also connected to the overpressure return system 27 via piping system 47–50, etc. (FIG. 3) which compensates for changes in water volume or pressure. During the load cooling-mode operation of the system 20, the relatively cold water from the pressurized heat exchanger system 21 is driven by ice system pump 28 to the utilization circuit 22, then is circulated therein by pumps 35 to extract heat from the environment of the loads of the utilization circuit (for example, water coil heat exchanger units of a building air conditioning system). The resulting relatively warm water is then returned to heat exchanger system 21 for cooling. At heat exchanger 21, refrigerant piped through the bottles 40 in pipes 55–60 extracts heat from the water prior to its return to the utilization system 22. The system 20 can also be operated in the storage-only mode in which ice is formed and stored about the refrigeration pipes 55–60 (FIGS. 8 and 10) when water is not being circulated through the secondary system.

Furthermore, depending upon the load and the system capacity, ice can be generated and stored simultaneously with the circulation of water in the secondary circuit and the use of the utilization system 22 in its cooling or air conditioning function. Finally, the system 26 is designed so that water can be circulated to melt the ice from one bottle before the others, as by the use of bypass 39 which can be selectively brought into operation by a control valve (not shown) to circulate water temporarily through bottle 40A alone. This first-melted storage unit will then be cleared of ice or have reduced ice thickness on the evaporator piping 55–60, thereby improving the heat transfer characteristics of the bottle should it be desired to operate it as a live load chiller concurrently with the melting of ice from the other bottles.

In the exemplary system 20, the blending circuit 29 provides separation of the primary and secondary circulation systems and thus selection of the storage and cooling modes of operation. This circuit also allows controlled blending of the water output at 36 from the primary circuit with the output 44 from the secondary circuit to allow selective and controlled adjustment of the temperature of the water supplied to the load system 22 to a value intermediate the water temperatures at the final outlet of the ice bottles. The blending system includes a valve 68 (either manual or automatic), which is connected between the ice bottle outlet 36 and the utilization system inlet 46, and a pair of bridges 66 and 67. These bridges extend on either side of the valve 68 between the ice bottle inlet 34 and outlet 36. A second typically manual valve 69 is formed in bridge 66. During ice building only operation, valve 68 may be closed and bridge valve 69 opened so that the water circulation provided by pump 28 is limited to the ice bottles 40A–D. In many systems thermal mixing will normally provide adequate water movement for heat exchange between the refrigerant pipes and the water. Consequently, the pump 28 need not be operated during the ice storage-only operation.

To effect chilled water circulation in the secondary or utilization circuit, both the ice pump 28 and the utilization circuit pump 35 are on. Valve 68 is open and bridge valve 69 is closed to eliminate the bridge between the input/output circuits and thereby separate the input/output flow. Water is circulated in the primary circuit within the bottles 40A–D, to and through the utilization system 22, and back to the bottles without blending. If blending is desired, valve 68 is opened and bridge valve 69 is also opened to a modulated position. The blending of utilization system output into heat exchanger output modulates the water temperature entering the utilization system to a desired value.

Cool storage utilization systems may operate most efficiently at a particular value or range, perhaps 15° F., for the temperature differential between the storage media water temperature (recognizing that the temperature of the water at the ice/water interface is 32° F. as the ice melts, gives up 144 BTU/lb, and becomes water again) and the load system return temperature. In ice storage systems such as 22, the water temperature at ice bottle outlet 36 is the above-mentioned 32° F., whereas the load return water at 44 is typically about 55° F. Blending as described above can be used to increase the temperature at load inlet 46 to the approximately 40° F. value which will establish the desired temperature swing, or the very cold 34° F. to 36° F. water can be made available to systems which are designed to provide the 42° F. to 43° F. air previously mentioned as producing operating benefits.

Figure 11:
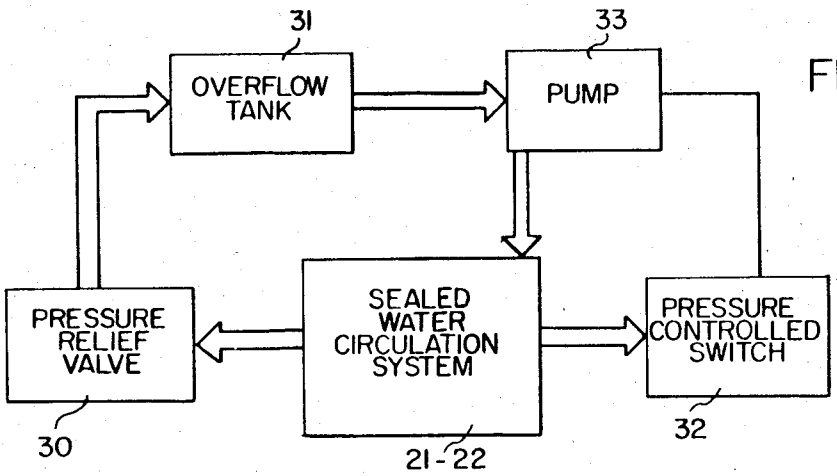
FIG. 11 is a separate block diagram of the overpressure/return circuit shown in FIGS. 2 and 3.

As mentioned, the primary purpose of the pressure/-volume compensation system 27 is to compensate for changes in internal system volume/pressure which occur when ice is made (stored) or melted. Ice occupies approximately nine percent greater volume than water. In order to prevent too great an internal pressure when ice is stored or to maintain a fully charged system during ice melting, the respective overpressure and return capabilities of system 27 are activated. Referring to FIG. 3 and to the separate block diagram of FIG. 11, the compensation system 27 comprises pressure relief valve 30 which opens at a predetermined pressure to allow internal system pressure to purge water from the chilled water system during ice formation. This water is stored in the atmospheric pressure, traveling water storage tank 31. The O/R system 27 further comprises one or more pumps 33—33 which are activated by means such as pressure-controlled switch 32 and by a lower water pressure in system 26 to supply or return water from the tank 31 to the system 21–22. In the exemplary embodiment of FIG. 3, a pair of small volume, high-pressure turbine pumps are used. Thus, when ice builds up within the heat exchanger bottles 40, pressure relief valve 30 opens at the preselected higher pressure to safely extract water from this system and compensate for the greater volume of ice. In contrast, as the system pressure lowers to a preselected value due, for example, to part or all of the ice within the system being melted (and cooling capability being extracted from "storage"), the pumps 33—33 are activated to supply water to and thereby charge the system. It should be apparent that other approaches could also be used to achieve this volume/pressure compensation.

Compensation system 27 also may include a pressure transducer 70 which is activated in response to a preselected head or internal pressure of tank 31 to open valve 38 and replenish water from an external supply (not shown). Because the pressure/head is related to the amount of ice in storage, the transducer 70 also can be used to control a gage or other read-out device for indicating the amount of thermal load which has been handled by the melting of stored ice.

The traveling water storage tank 31 operates at atmospheric pressure and thus requires that internal system components be coated to avoid rust. However, the remainder of this system is a closed pressurized system. This permits the water which circulates in the chill water utilization system and the water stored in the traveling water storage tank 31 to be treated water similar to that utilized in the pressurized chill water circuit of the prior art system. However, this treated water is the only water utilized in the ice building process within the ice bottles. Thus, the internal components of the ice bottles including refrigerant tubes, baffles, and tube cradle sheets need not be coated with rust proofing materials since rust inhibition is carried out by the chemical treatment of the water.

Various other conventional shutoff valves and components may be used in the system of FIG. 3. For example, ice pump 28 may have gage 71 spanned by a pair of shutoff valves 72 and 73 which can be individually operated to give readings of water pump input and output pressure. The pump 28 is spanned by shutoff valves 74 and 76 which permit isolating the pump for removal or maintenance.

A preferred system for supplying condensed refrigerant to the refrigerant evaporator tube bundles in the ice bottles is shown FIG. 4 and the front elevation view of FIG. 7. Refrigerant enters the ice bottles 40 via the parallel-connected system of inlet headers shown in FIG. 7 and thermally-controlled expansion valves 81. These valves can be controlled by sensors such as transistors 82—82, and, specifically, by conventional thermistor control circuits which enable the valves 81 to regulate the inlet of refrigerant based upon the temperature of the suction gas leaving the bottles 40 at 82. It should be noted that the multiple bottle system uses parallel-connected refrigerant piping, both between bottles and within bottles. This approach equalizes the cooling potential of each bottle 40 and permits comparable water-cooling and ice-making capacity along each serpentine refrigerant tube element 55–60 (FIG. 8). As a result, total system cooling potential is optimized.

After passage through the evaporator piping to extract heat from the system water, the refrigerant exits via valves 83—83 as wet "suction" gas and "dumps" into accumulator tank 84. This tank contains a conventional demister screen 86 which facilitates separation of the gas and liquid phases of the leaving suction gas. The gas is picked up by standpipe 87 and fed through line 88 under compressor suction to filter dryer 89 and on to the compressor 23, from which the compressed hot gas is discharged to condensor 24. The condensor 24 extracts heat from and condenses the refrigerant gas to liquid form. Heat removal here is by water or evaporator or other conventional approach. From the condensor 24, the still-hot refrigerant liquid is returned to the accumulator tank 84 and is passed through a coil heat exchanger 91 for cooling by the incoming suction gas. The refrigerant then egresses tank 84 via valve 92 for return via the thermally-controlled evaporator valves 81 to the heat exchanger bottles 40. A piping system 93 siphons oil "rich" liquid refrigerant from accumulator tank 84 into line 88 for lubricating the compressor 23.

The refrigerant system 25 also includes high level float control vent 99 which stops the compressor in the event of too high a liquid level (and possible "slugging") in tank 84. The described refrigeration system is exemplary only. Various other types of generally accepted refrigeration methods, such as pumped overfeed, injection, etc., could be applied by those skilled in the art to the ice bottle system of this inventor.

The applicability of this invention to a specific application in a high-rise building air conditioning system application will now be discussed. The building itself is a 15 plus story high-rise building containing approximately 420,000 square foot of space as the load and having an approximate height of 200 feet which establishes the minimum hydrostatic head of the system. The heat exchanger system 21 contains eight of the ice bottles 40 in a concrete vault. Each bottle is approximately 40 feet long and 36 inches in diameter and contains six, 1¼-inch O.D. serpentine refrigeration coils. Each coil is approximately 330 feet long, providing a total of 1980 feet of refrigeration coil in each bottle.

The water circulation system uses nominal 6-inch piping and operates at a system pressure of about 90–100 psi. Ice system pump 28 and utilization system pump 30 have nominal ratings, respectively, of 1000 gpm (gallons per minute) and 750 gpm. The refrigeration system 25 uses R22 refrigerant. Refrigerant compressor 23 has a nominal rating of 90 tons, which establishes the cooling rate of the system 20 in cooling and/or storing ice (that is, without withdrawal from storage). The eight bottles give this system the capacity to store over 100,000 pounds of ice. This is approximately 1800–2000 ton-hours of refrigeration storage, giving a withdrawal capability of about 450 tons per hour for four hours. The ice bottle thermal storage system supplements a conventional chill water system to facilitate handling of peak loads.

Figure 14:
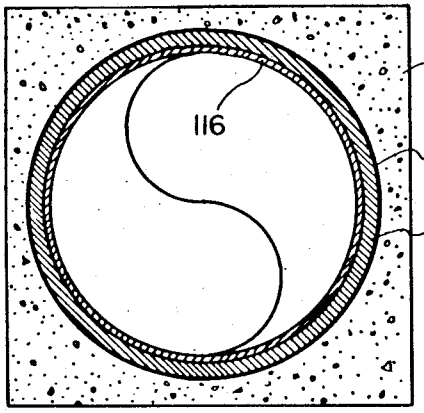
FIGS. 12–14 illustrate a second embodiment of this invention incorporating a single pass water circulation arrangement.
Figure 12:
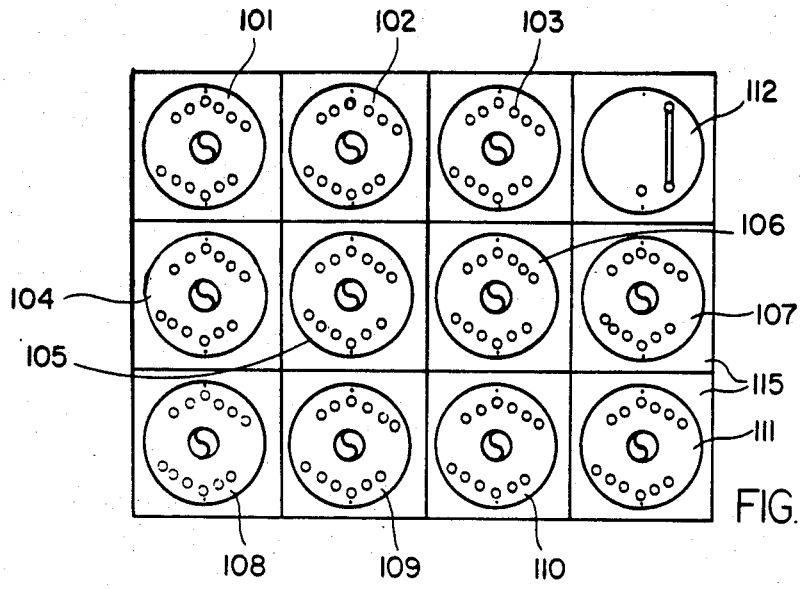
Figure 13:
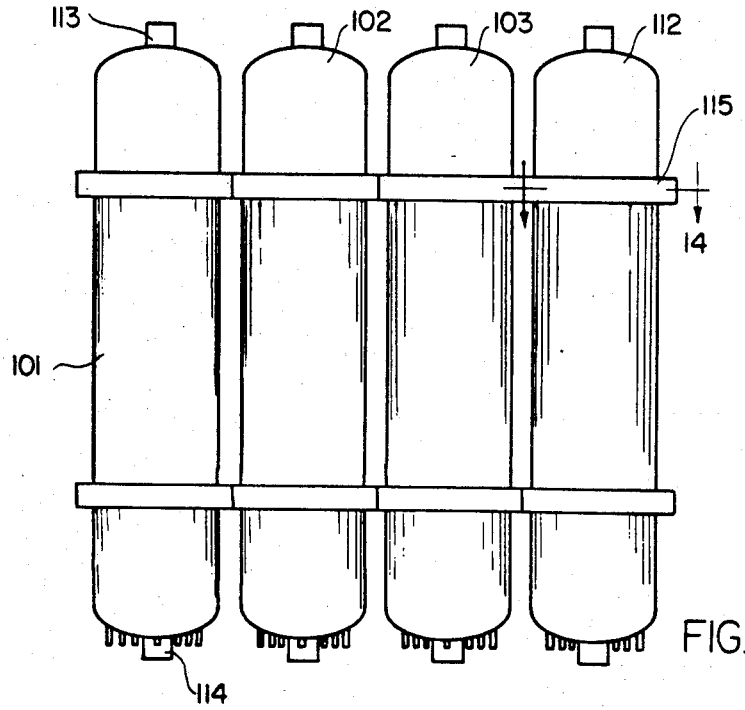

Referring now to FIGS. 12–15, a second embodiment of this invention utilizing a single pass ice bottle structure will now be described. In addition, the system embodiment shown in FIGS. 12–15 incorporates a certain additional preferred features which have been contributed by the commercial implementation of the system by Midwesco, Inc., of Niles, Ill., a commercial licensee under the invention. FIGS. 12–14 illustrate only the structure and arrangement ice bottles themselves and the overflow traveling water tank and not the other components and connections of the overall chill water system which would remain similar to those disclosed in previous drawing figures.

As shown in FIG. 12, the particular system installation depicted involves the use of eleven ice bottles 101–111 together with a traveling water storage bottle or tank 112. The eleven ice bottles and the storage tank are mounted in an array of three rows by four columns. Each of the ice bottles, for example, ice bottle 101, has a water inlet port 113 and a water outlet port 114. The refrigerant inlet and outlet arrangements including parallel, interconnected inlet and outlet headers involves an overall arrangement similar to that depicted in FIG. 7 and FIG. 9. The same serpentine arrangement of six refrigerant tube bundles is employed in the individual ice bottles, but the central baffle dividing the bottle into two separate flow compartments is eliminated in this single pass system.

The individual ice bottles 101–111 and storage bottle 112 are supported on concrete collar arrangements 115 which are preferably integrally formed on each of the ice bottles, at two forward and rearward locations as shown in FIG. 13. Each of the ice bottles preferably has a bottle shell structure as depicted in FIG. 14, including a permanently insulated bottle shell utilizing the PERMA-PIPE TM process of Midwesco, Inc., which will be briefly described below.

The integral support collars 115 are molded onto the outer surface of the individual ice bottles by first forming sheet collar forms having front and back sides, as well as closed ends on two sides and the bottom into which concrete may be poured. This form may be removed after pouring and settling of the concrete and an integral concrete collar will then be in place for supporting each of the bottles in a row and column array as shown in FIG. 12.

FIG. 14 shows a cross-section through the individual ice bottles. The metal walls 116 of the steel bottle may comprise an elongated steel pipe section having a wall thickness of 0.25 inches and an outer diameter of 42 inches. A layer 117 of foam insulation is present on substantially the total length of the outer surface on the pipe wall 116 to a thickness of about one and one-half inches. This foam is a polyurethane insulation material which can be gradually built up on the outer surface by a spraying process. After the layer of polyurethane insulation 117 is formed on the outer pipe surface, a fiberglass reinforced plastic jacket is formed using a winding process to a thickness of about one quarter inch to encapsulate the polyurethane insulation and to waterproof and vapor seal the entire main body of the bottle. The steel end walls of the ice bottles are similarly covered with a layer of insulation and a layer of fiberglass reinforced plastic molded thereover to provide a totally water impervious and vapor sealed jacket for the steel pipe and end caps forming the ice bottle pressure vessel.

Figure 15:
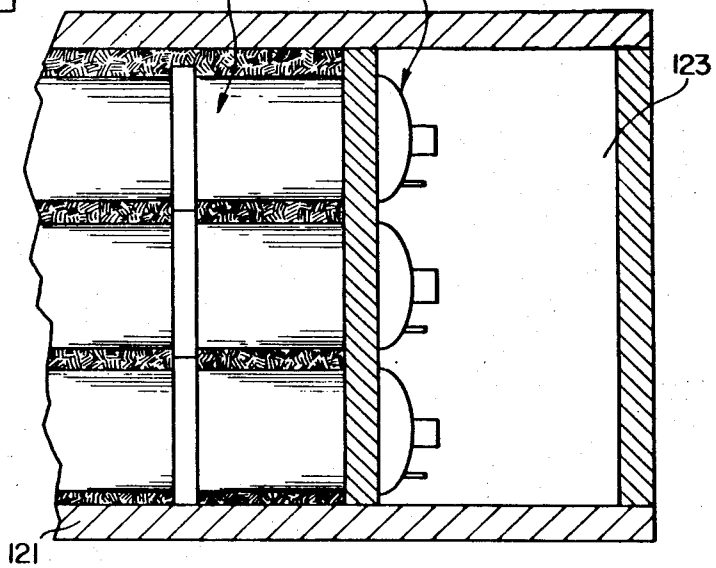

This manufacturing technology permits the stacked ice bottle and storage tube array to be directly buried as shown in FIG. 15 with the portion 120 of the array directly buried in earth while supported on a concrete pad 121. Only the front end 122 of the ice bottle array need be exposed in a vault region 123 for access to the refrigerant inlet and outlet headers and associated refrigerant circuit components for maintenance and inspection. The direct burial section 120 of the ice bottle array may be located under a paved parking lot, or under a landscaped area surrounding a building, or under the basement of the building where parking may be accommodated. Accordingly, the ice bottle array can be placed in a location which does not occupy otherwise usable building space since access to the interior of the ice bottles is not required for maintenance or repair.

It should be apparent from the above description of two alternative embodiments of this invention that this invention represents a dramatic enhancement of the general concepts of thermal storage using ice building systems and eliminates certain inherent disadvantages in the prior art technologies. After only a brief period of market development, a substantial number of air conditioning projects are switching to a thermal storage, ice building approach which utilizes the features and concepts of this invention. The technology of this invention substantially simplifies the overall implementation of an ice storage system, enhances the generic advantages of the ice storage approach to thermal storage, and eliminates major objectional features of the prior art technology.

The above embodiments are given by way of example only for those skilled in the art will quickly appreciate that many variations in the specific parameters and structures can be made, and indeed, that the system 20 and heat exchanger system 21 have wide application where cooling and/or thermal storage is indicated. For example, the above system can be adapted to cool the molds used for rubber vulcanizing; to cool the barrels used for mixing dough used in baking; to provide cooling for dairy pasteurizing units; and to serve various cooling functions in pharmaceutical, chemical, food processing and other industries.

Numerous other applications and variations will be readily implemented in practicing the present invention. As only one example, if it is desired to limit the ice-building capacity of the system, contacts may be positioned adjacent the evaporator pipes or coils 55–60 for shutting off the compressor(s) at a predetermined thickness of ice.

What is claimed is:

1. In a chill water system, in combination:

structural means defining a closed vessel for containing a volume of water entirely filling said vessel;

heat exchanger means for forming a volume of ice within said vessel;

chill water utilization means communicating with said closed vessel including means for circulating water under pressure through said vessel in contact with said volume of ice;

overflow tank means for containing a volume of water and being open to atmospheric pressure; and compensation means for automatically removing water from said closed vessel to said overflow tank means during formation of said volume of ice to prevent build up of destructive internal pressures and for automatically returning water from said overflow tank to said closed vessel during melting of said volume of ice by said circulating water to maintain water pressure and volume in said closed vessel.

2. The system of claim 1, wherein said heat exchanger means includes a solid heat exchange surface area disposed within the interior of said vessel for forming said volume of ice surrounding and adhering to said heat exchange surface area.

3. The system of claim 2, wherein said structural means comprises an elongated cylindrical vessel having first and second ports therein for entry and exit of circulated water; said heat exchanger means comprises a plurality of refrigerant carrying tubes each disposed in a serpentine arrangement of individual tube sections extending substantially the entire length of said vessel such that said volume of ice is formed as a cylindrical volume of ice surrounding each of said tube sections.

4. The system of claim 3, wherein said first and second ports are formed in opposite end walls of said elongated cylindrical vessel and said water circulating through said vessel flows around said cylindrical volumes of ice in passing from said first port to said second port.

5. The system of claim 4, further comprising a plurality of support elements for said tube sections located at spaced positions between said opposite end walls of said cylindrical vessel for disturbing the water flow pattern from one end of said vessel to the other into a turbulent flow pattern for enhanced transfer of heat from said water to said cylindrical volumes of ice.

6. The system of claim 3, wherein said first and second ports are formed in one end wall of said elongated cylindrical vessel on opposite halves thereof; and further comprising an elongated baffle plate mounted within said elongated cylindrical vessel and extending from said one end wall toward the opposite end wall to divide said vessel into a first compartment communicating with said first port and a second compartment communicating with said second port with said first and second compartments communicating with each other at the end of said vessel opposite said one end wall thereof whereby the water circulated through said vessel passes serially through said first and second compartment in heat transfer relation with the cylindrical volumes of ice located in each.

7. The system of claim 2, wherein said structural means defines a plurality of separate closed vessels each containing a volume of water entirely filling said vessel; said heat exchanger means includes a separate solid heat exchange surface disposed within the interior of each of said closed vessels for forming separate volumes of ice surrounding and adhering to said heat exchange surface area; said chill water utilization means communicates with each of said closed vessels and includes means for circulating water under pressure through each of said vessels in series; and said compensation means communicates with each of said separate vessels for automatic removal and return of water thereto.

8. The system of claim 7, wherein said compensation means further comprises a water circuit communicating with the interiors of each of said separate closed vessels and said overflow vessel; pressure responsive means communicating with said water circuit for admitting water to said overflow vessel from said separate closed vessels in response to a sensed pressure exceeding a preset value during periods when ice is formed in said separate vessels; and a second pressure responsive means communicating with said water circuit for pumping water from said overflow vessel to said separate closed vessels during periods when ice in said separate vessels is being melted.

9. The system of claim 7, wherein each of said separate vessels comprises an elongated cylindrical vessel having first and second ports therein for entry and exit of circulated water; said heat exchanger means comprises a plurality of refrigerant carrying tubes each disposed in a serpentine arrangement of individual tube sections extending substantially the entire length of said vessel such that said volume of ice is formed as cylindrical volume of ice surrounding each of said tube sections; said first and second ports of said individual vessels beings coupled together in a series circuit of water flow through said vessels.

10. The system of claim 9, wherein said first and second ports are formed in opposite end walls of said elongated cylindrical vessel and said water circulating through said vessel flows around and through said cylindrical volumes of ice in passing from said first port to said second port.

11. The system of claim 9, wherein said first and second ports are formed in one end wall of each of said elongated cylindrical vessels on opposite halves thereof; and further comprising an elongated baffle plate mounted within said elongated cylindrical vessel and extending from said one end wall toward the opposite end wall to divide said vessel into a first compartment communicating with said first port and second compartment communicating with said second port with said first and second compartments communicating with each other at the end of said vessel opposite said one end wall thereof whereby the water circulated through said vessel passes serially through said first and second compartments in heat transfer relation with the cylindrical volumes of ice located in each.

12. The system of claim 11, wherein each of said plurality of refrigerant carrying tubes disposed within each of said separate vessels has its refrigerant entrance and exit ends extending through said one end wall of said vessel, said vessels are arranged in a generally side-by-side parallel arrangement of individual vessels; each of said vessels has said one end wall extending through a common wall and the remainder of each of said vessels being totally surrounded by insulating material to isolate said arrangement of vessels form ambient temperatures.

13. The system of claim 2, wherein said structural means comprises a plurality of separate elongated cylindrical vessels having inlet and outlet chill water ports connected together for series flow of chill water through said vessels in contact with the ice therein; said heat exchanger means comprises a plurality of separate refrigerant carrying tubes disposed within each said vessel, each of said refrigerant carrying tubes having a prearranged serpentine configuration of substantially equal length tube sections extending longitudinally within said vessel; and an inlet and outlet port, said inlet and outlet ports of said separate refrigerant carrying tubes being coupled in parallel for connection to a common supply and return system such that substantially uniform concentric volumes of ice are formed on each of said tubes as liquid refrigerant is circulated therethrough.

14. In a method for providing chilled water under pressure to a chill water utilization circuit, the steps of:

disposing a closed vessel in communication with said chill water utilization system;

disposing an open atmospheric vessel in the vicinity of said closed vessel;

filling said closed vessel entirely with water;

forming a volume of ice within said closed vessel;

removing a volume of water from said closed vessel to said open atmospheric vessel as said volume of ice is formed to prevent destructive build up of pressure within said closed vessel;

circulating water from said chill water utilization circuit through said closed vessel in contact with said volume of ice for producing chilled water and thereby melting said ice; and returning water from said open atmospheric vessel to said closed vessel as said ice is being melted to maintain water pressure and volume within said closed vessel.

15. The method of claim 14, wherein said step of forming a volume of ice comprises disposing a plurality of equal length serpentine arrangements of refrigerant tubes within said closed vessel and circulating liquid refrigerant through said refrigerant tube arrangements in parallel to form ice concentrically around each of said refrigerant tubes.

16. A method for providing chilled water under pressure to a chill water utilization circuit, the steps of:

disposing a plurality of closed vessels in series communication with each other and with said chill water utilization circuit;

disposing a single overflow water tank in the vicinity of said closed vessels in communication with each of said closed vessels;

forming volumes of ice within each of said closed vessels;

sensing overpressure within said interconnected closed vessels as said ice is formed therewithin;

removing volumes of water as necessary from each of said closed vessels to said overflow water tank in response to said sensed overpressure;

circulating water from said chill water utilization circuit in series through said closed vessels in contact with said volume of ice for producing chilled water and thereby melting said ice;

sensing underpressure within said interconnected closed vessels as said ice is melted; and returning water from said overflow water tank to said closed vessels in response to said sensed underpressure.

* * * * *